US005967356A

United States Patent [19]

Laarhoven et al.

[11] Patent Number: 5,967,356

[45] Date of Patent: Oct. 19, 1999

[54] TRANSPORT AND STORAGE CONTAINER

[75] Inventors: Hans Laarhoven, Apeldoorn, Netherlands; Horst Banaskiwitz, Berlin, Germany

[73] Assignee: Wavin Trepak Holding BV and bekuplast Kunstoffverarbeitungs-GmbH and Ringe, Hardenberg, Germany

[21] Appl. No.: 08/913,909

[22] PCT Filed: Jan. 25, 1997

[86] PCT No.: PCT/EP97/00348

§ 371 Date: Nov. 7, 1997

§ 102(e) Date: Nov. 7, 1997

[87] PCT Pub. No.: WO97/27115

PCT Pub. Date: Jul. 31, 1997

[30] Foreign Application Priority Data

| | | | |
|---|---|---|---|
| Jan. 26, 1996 | [DE] | Germany | 196 02 651 |
| Apr. 2, 1996 | [DE] | Germany | 196 13 086 |
| Jun. 14, 1996 | [DE] | Germany | 196 23 690 |

[51] Int. Cl.[6] ..... B65D 6/18; B65D 6/22

[52] U.S. Cl. ..... 220/6; 220/4.28; 220/615

[58] Field of Search ..... 220/6, 7, 1.5, 4.28, 220/4.31, 4.33, 4.34, 617, 682, 691, 692, 693, 621, 622, 677, 615; 217/12 R, 13, 15, 16, 43 R, 45, 47, 48; 206/503, 600

[56] References Cited

U.S. PATENT DOCUMENTS

| | | | |
|---|---|---|---|
| 3,628,683 | 12/1971 | Friedrich | 220/6 |
| 4,186,841 | 2/1980 | Buckley et al. | 220/7 |
| 4,240,555 | 12/1980 | Jurasek | 220/7 |
| 4,674,647 | 6/1987 | Gyenge et al. | 220/6 |
| 4,693,386 | 9/1987 | Hughes et al. | 220/6 |
| 5,323,921 | 6/1994 | Olsson | 220/7 |
| 5,467,885 | 11/1995 | Blinstrub | 220/6 |
| 5,588,549 | 12/1996 | Furtner | 220/6 |

*Primary Examiner*—Allan N. Shoap
*Assistant Examiner*—Niki M. Eloshway
*Attorney, Agent, or Firm*—Hill & Simpson

[57] ABSTRACT

The invention concerns a transport and storage container comprising a base (30) and four collapsible side walls (10, 20) and having the following features: two first side walls (10) have corner-embracing wall end regions (11); the corner-embracing wall end regions (11) and the two side walls (20) are designed with connection wall regions (12; 22) which overlap each other in the erected state; the base (30) is designed with two wall plinth regions (31) which form the lower part of the first side walls (10) and comprise corner-embracing plinth end regions (131), the corner-embracing length of the plinth end regions (131) being shorter than the corner-embracing length of the wall end regions (11); two second side walls (20) are designed with laterally projecting widenings (21) which lie at the level of the wall plinth regions (31) and, in the erected state of the side walls (10, 20), lie between the corner-embracing wall end regions (11) and the base (30); the pivot axes (18) of the first side walls (10) are disposed at a greater vertical spacing above the base (30) than the pivot axes (28) of the second side walls (20); and the vertical spacing of the pivot axes (18) of the first side walls (10) from the top (35) of the base (30) corresponds substantially to the length of the corner-embracing wall end regions (11) measured in the horizontal direction.

23 Claims, 9 Drawing Sheets

TRANSPORT AND STORAGE CONTAINER

BACKGROUND OF THE INVENTION

The invention relates to a transport and storage container with a substantially rectangular base and four side walls.

FIELD OF THE INVENTION

Transport and storage containers are known in most variable designs wherein particularly containers of plastic material with an increasing tendency are used for multiple use containers, and replace one way packages. In order to transport and store empty multiple use containers with as little space as possible it is practical and also known to design these containers with collapsible side walls.

A first collapsible transport containers is known from DE 29 00 857 A1. This transport container consists of a rectangular base plate and four side walls articulatedly connected with the base, with the side walls folding inwards and stiffened with ribs. With this container a pair of opposite side walls with cams fastened thereto is guided in circular-shaped guiding slots in the other pair of opposite side walls. The separation line between the adjacent side walls extends directly in the corner region of the transport container.

It is considered a disadvantage of this known transport container that the manufacturing thereof is comparatively costly because of the circular guiding slots guiding the cams, and that the cams are parts subject to damage which may easily break or be deformed when handled without care such that the function of the transport container is impaired. Furthermore, as the separating line between the adjacent side walls extends directly in the corner region each of the four side walls. As a result, the corner regions may be easily deformed despite the stiffening ribs provided. Therefore this transport container is not very suitable for the storage and the transport of heavy goods particularly when several loaded transport containers are stacked one on top of the other.

From the EP 0 655 392 A2, furthermore a collapsible container is known with four folding side walls. With this container the pivot axes for the side walls are disposed in pairs at different levels wherein the top most pivot axis for the one pair of side walls is disposed so high that a reduction in height of the folded container is only one third of the original height when the side walls are erected.

Furthermore, a collapsible container is known from the EP 0 385 914 B1 comprising a base part and four side walls wherein the side walls also are collapsible inwards. The one pair of side walls is designed with corner-embracing wall regions such that the container comprises a relatively high stability and load carrying capacity in particular when several loaded containers are stacked one on top of the other. However, it is a disadvantage of this known container that, in the folded state, only a limited reduction of height is attained as the remaining height of the container with collapsed side walls is about 40% of the original height of the container when the side walls are erected.

A collapsible transport container is known from DE 81 19 990 U1 which consists of a base plate, four side walls collapsible inwards and being disposed opposite in pairs, and with a plurality of hinges for connecting the side walls to the base plate wherein preferably two opposite side walls are directly connected to the base plate, and the two other opposite side walls are indirectly connected to the base plate by means of borders facing substantially perpendicularly the base plate, and wherein the side walls for the connection with each other in the erected state include guiding stubs, guiding apertures corresponding to the guiding stubs, and snap-in elements. Furthermore, it is provided with this known transport container that the side walls connected to the base plate by means of the borders at their edges extending perpendicularly to the base plate when erected are provided with stop webs extending substantially along the total length of the edges with the stop webs abutting at the side walls directly connected to the base plates. With this known transport container a good reduction of the height of the container by folding the side walls is attained, however, the container will carry only small loads because of the design of the side walls, and the container is only suitable for small loads applied by further transport containers stacked on top. Therefore, there is no safety attained with this transport container for an economic use in practical experience. Furthermore, it is a disadvantage that the locking of the side walls in relation to each other is unreliable when erected and therefore the stability of the container is not sufficiently guaranteed. Finally, the mounting of the container takes much effort which in particular is caused by the great number of hinges.

Finally, a collapsible container is known from the WO 95/18048 which also comprises a substantially rectangular base and four pivotable side walls connected thereto and folding inwards. It is essential with this known container that the side walls are designed with flange regions which in the erected state are in toothed engagement with each other. This toothed engagement requires a relatively complicated shape of the connection regions of the side walls and requires an expensive manufacturing. Furthermore an exact positioning of the connection regions is required when connecting the side walls with each other in the erected state in order to attain the engagement. Furthermore it is a disadvantage of the known container that it will carry no large loads when several loaded containers are stacked one on top of the other as the side walls substantially are designed as flat rectangles which have only little stability against distortion. This known container is only slightly suitable for the storage and transport of relatively heavy goods.

SUMMARY OF THE INVENTION

Therefore it is the object to provide a transport and storage container comprising a high, long lasting durability and stability even when stacking several loaded containers one on top of the other, which may be easily manufactured and handled, and with which a greater reduction of the height is attained between the height when the side walls are erected and when they are collapsed.

According to the invention this object is attained by a transport and storage container according to the patent claim 1.

The container is particularly stable and suitable for taking large loads also when stacked by the corner-embracing wall end regions of the first side walls, and by the corner-embracing plinth end regions of the base. The wall plinth regions provided at the base below the first side walls serve for a high stability of the base such that the latter will not bend even under high loads. The laterally projecting widenings or lateral extensions of the second side walls serve for a direct transfer of the stacking loads in vertical direction from top to bottom when the load acts at the wall end regions of the first side walls. Simultaneously the arrangement of the pivot axes as far out as possibly close to the border of the base, is possible without impairing the folding capacity of the first side walls with the corner-embracing wall end regions. The arrangement of the pivot axes of the first side walls, and the second side walls at different levels enables the folded side walls to be placed one on the other without any problems wherein the second side walls when folded lie below the first side walls. The essential advantage is gained that the wall end regions with their front lateral edges when erected in the folded state will lie at the base of the container such that a very large reduction of height is attained between the original height of the container with erected side walls, and the height with folded side walls.

In an alternate embodiment of the container, an even larger reduction in height is provided as the front edges of the corner-embracing wall end regions will lie at the level of the underside of the base when folded.

Pursuant to the present invention, a collapsible container is provided which includes a substantially rectangular base having a first pair of opposing edges and a second pair of opposing edges. The first pair of opposing edges are connected to one of two opposing first sidewalls and the second pair of opposing edges are connected to one of two opposing second sidewalls thereby forming an open-top, four-walled rectangular container.

Each edge further comprises an upwardly extending plinth region so that the first pair of opposing edges each comprises a first plinth region that is disposed underneath and which supports a first sidewall and the second pair of opposing edges each comprise a second plinth region which is disposed underneath and supports one of the second sidewalls.

The first and second sidewalls can pivot between a collapsed position and an upright position.

Each first sidewall comprises two opposing ends that each form corners thereby providing the four corners of the container. Each of the corners comprises a corner embracing wall that is connected to a thin connecting wall region or extension. Similarly, each first plinth region also comprises two opposing ends that form corners which are disposed underneath the corners formed by the first sidewalls. The connecting wall regions of the first sidewalls extend past the corners formed by the opposing ends of the first plinth regions.

Each second sidewall also includes two opposing ends that terminate in connecting wall regions. Each connecting wall region of the second sidewall is in an abutting engagement with a connecting wall region of one of the first sidewalls when the first and second sidewalls are in the upright position.

The first plinth regions have a greater height than the second plinth regions. Because the pivoting axis of the first and second sidewalls is defined by the first and second plinth regions respectively, the lower second plinth regions provide a lower pivot axis than the higher first plinth regions and therefore, in the collapsed position, the second sidewalls are pivoted downward onto the base with the first sidewalls pivoted downward on top of the second sidewalls.

The second sidewalls further comprise a lower edge that comprises two opposing lateral extensions. Each lateral extension is disposed underneath at least part of the corner of a first sidewall when the first and second sidewalls are in the upright position.

In an embodiment, the opposing edges that are connected to the second plinth regions further comprise a recess for accommodating the connecting wall regions of the first sidewalls when the first sidewalls are in the collapsed position.

In an embodiment, the corner embracing walls of the first sidewalls have a length that ranges from about 5% to about 15% of the length defined by the portion of the first sidewall that extends between the opposing corner embracing walls.

In an embodiment, the length of the corner embracing walls ranges from about 8% to about 10% of the length of the sidewall that extends between the corner embracing walls.

In an embodiment, the first and second sidewalls are connected to their respective first and second plinth regions by a hinge mechanism.

In an embodiment, the first and second sidewalls are connected to their respective first and second plinth regions by a plurality of hinge mechanisms.

In an embodiment, the hinge mechanisms comprise a lower laterally extending axle stub that is connected to a lower edge of its respective sidewall by a web. The axle stubs are received in a recess disposed on the upper edge of its respective plinth region.

In an embodiment, at least the hinge mechanisms which connect the first sidewalls to the upper edges of the first plinth regions further comprises a frictional element which holds the first sidewalls in an upright position without support from the second sidewalls.

In an embodiment, the first sidewalls comprise a lower outer apron that engages the first plinth regions when the first sidewalls are in the upright position.

In an embodiment, the first sidewalls further comprise a lower outer wing structure that engages the first plinth regions when the first sidewalls are in an upright position.

In an embodiment, the container comprises a lock mechanism for locking the second sidewalls against the first sidewalls when the first and second sidewalls are in an upright position.

In an embodiment, each second sidewall comprises at least one lock for locking said second sidewall against a first sidewall when the first and second sidewalls are in an upright position.

In an embodiment, the lock mechanisms comprise a lock member that is movable between a locking and a retracted position.

In an embodiment, the lock mechanisms further comprise an actuating handle disposed at an end of the locking member. In still another embodiment, each sidewall comprises two locking members positioned at opposing side edges of the second sidewalls so that their actuating handles are disposed adjacent to one another so that they may be actuated simultaneously with a finger or thumb and, further, so that they may be actuated by an automatic handle device, more particularly, an automatic handle device for an automatic container washing unit.

In an embodiment, the upper edge of each first plinth region is inclined or sloped from the exterior to the interior of the container. Similarly, the lower edge of each first sidewall has a matching inclination or slope from the exterior to the interior of the container. The matching inclinations of the upper edge of each first plinth region and the lower edge of each first sidewall range from about 4 degrees to about 8 degrees from horizontal.

In an embodiment, the first plinth regions extend above the first and second sidewalls in the collapsed positions so that the upper edges of the first plinth regions provide a stacking surface for other collapsed containers when collapsed containers are stacked one on top of another.

BRIEF DESCRIPTION OF THE DRAWINGS

Subsequently embodiments of the invention are described referring to a drawing. In the Figures of the drawing.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
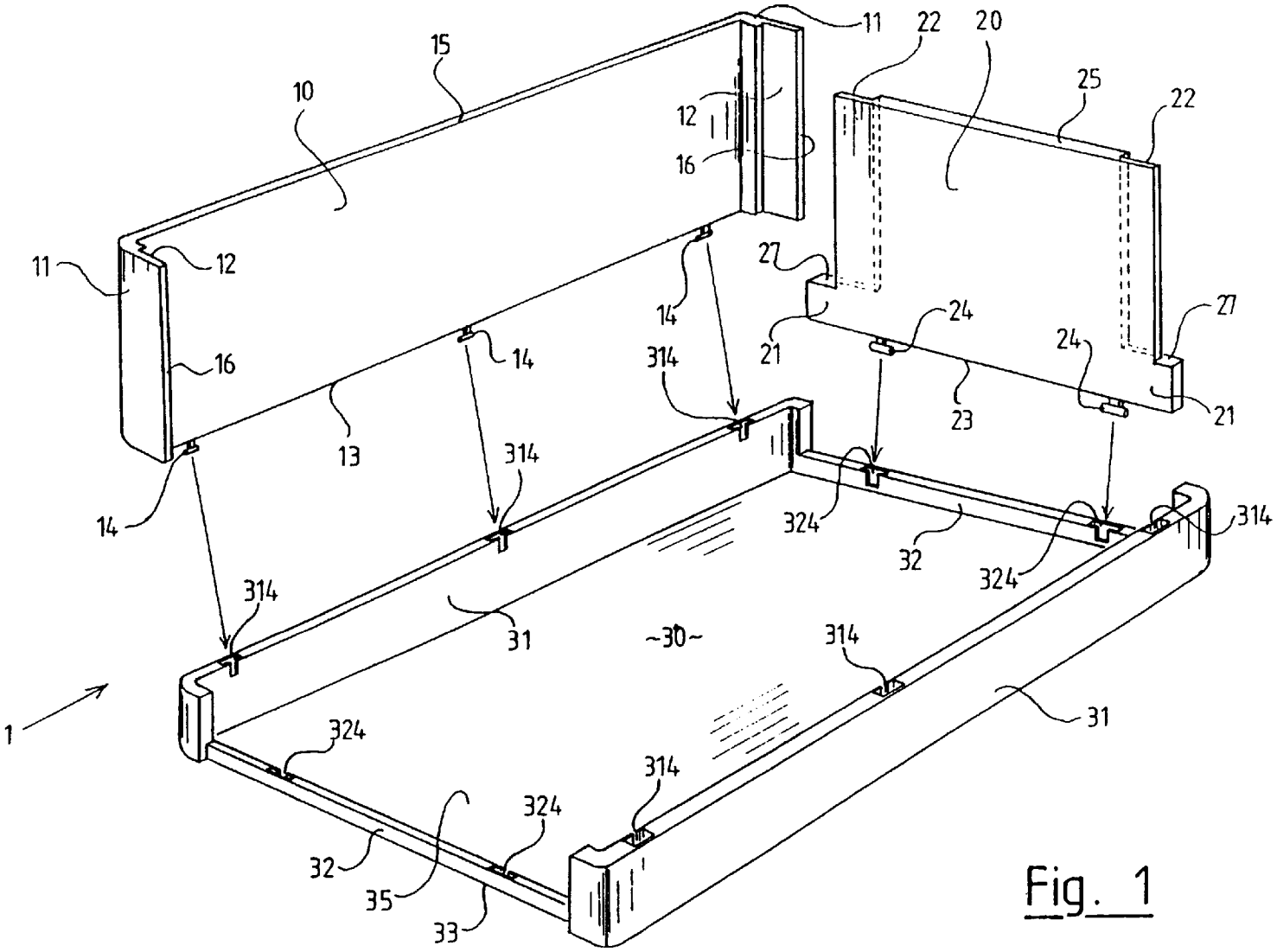
FIG. 1 illustrates a base, a first side wall, and a second side wall of a container of the present invention prior to the connection with each other in a schematic perspective view.

As it is illustrated in FIG. 1 of the drawing, the container 1 comprises a base 30 with a substantially rectangular contour, and with a non-visible underside 33, and with a top 35. At the two longitudinal borders of the base 30 each wall plinth region 31 protrudes upwards with the wall plinth region 31 being integral with the base 30. At the two front sides of the base 30 each further wall plinth region 32 is provided with the height of which being substantially lower when compared with the first nominated wall plinth regions 31. Furthermore at the second wall plinth regions 32 the wall thickness measured in horizontal direction is about half as large as the wall thickness of the first wall plinth regions 31.

Furthermore the container 1 in total comprises four side walls 10, 20 wherein FIG. 1 illustrates only two of the four side walls 10, 20. In FIG. 1 at the left side in the rear above the wall plinth area 31 positioned there the first side wall 10 is illustrated prior to its connection with the base 30. The side wall 10 at the lateral ends thereof each comprises a corner embracing wall region 11 in the course of which the wall thickness is reduced from the original dimension in a step to about the half of it. The wall region with the reduced thickness forms a connection wall region 12 which will be described below. The two corner-embracing wall regions 11 with the connection wall regions 12 end in a vertical front edge 16.

At the lower edge 13 of the side wall 10, several hinge elements 14 are attached which protrude downwards. These hinge elements 14 are to be inserted in corresponding hinge receiving apertures in the top side of the associated wall plinth regions 31, and are preferably snapped in there. In FIG. 1 at the right side in the rear the second side wall 20 is illustrated which at the lower side regions comprises a widening or lateral extension 21 projecting outwards. The top side of each widening 21 forms a support face 27 therefor each one of the corner-embracing wall regions 11 of the first side walls 10 will rest in the erected state. Furthermore it is visible at the second side wall 20 that this side wall at its lateral border regions above the widenings 21 comprises a wall thickness which is reduced by the half of the original wall thickness. By this feature, connection wall regions 22 are formed which correlate with the connection wall regions 12 of the first side walls 10.

The second side wall 20 at the underside thereof comprises several hinge elements 24 which protrude downwards also in this case and are insertable in corresponding hinge receiving apertures 324 in the second wall plinth region 32 of the base 30. The hinge receiving apertures 314 as well as the hinge receiving apertures 214 for practical reasons are open at the undersides thereof, and are designed with a relatively large clearance as far as the function is not impaired to prevent that dirt particles eventually penetrating will not stick and collect. The folding mechanism is not susceptible against dirt by this feature.

The first side wall 10 as well as the second side wall 20 are limited to the top by a smooth upper edge 15 or 25, respectively.

Figure 2:
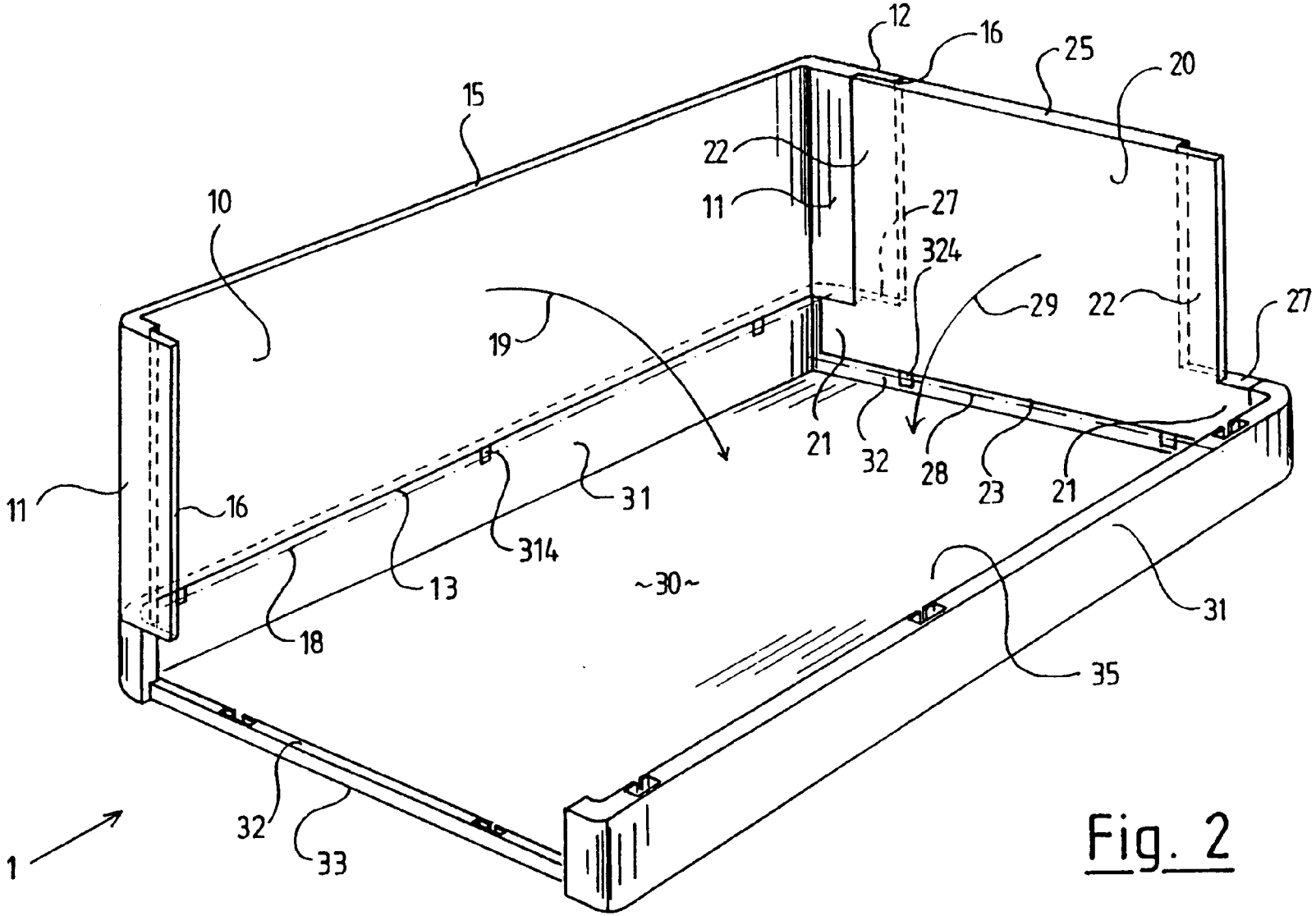
FIG. 2 illustrates the base, the first side wall, and the second side wall of the container shown in FIG. 1 after the connection with each other each in a schematic perspective view and wherein in both FIGS. 1 and 2 the two further side walls are omited to simplify FIGS. 1 and 2.

FIG. 2 of the drawing illustrates the container with side walls 10 and 20 in the state connected with the base 30. The two further side walls are ommited to simplify the Figure, naturally they are provided for forming the complete container 1. The design and arrangement of the not-illustrated two side walls are symmetric with the illustrated side walls 10, 20 such that a special Figure and explanation is not necessary.

In the state of the container 1 illustrated in FIG. 2 the hinge elements at the underside of the first side wall 10 and second side wall 20 are snapped in the associated hinge receiving apertures 314, 324 and not visible. By this means for each side wall 10, 20 a pivot axis 18 or 28, respectively, is formed which is illustrated in FIG. 2 by dash-dotted lines.

The pivot axes 18, 28 extend within the wall plinth region 31 in parallel with the edges of the base 30, however, at different levels. Therein the pivot axis 18 is positioned in a larger vertical spacing from the base than the pivot axis 28.

As indicated by the swivelling arrows 19, 29 the side walls 10, 20 are collapsible inwards to the base 30 about their associated pivot axes 18, 28. When collapsing the container 1 from the use state with erected side walls 10, 20 the front sided shorter second side walls 20 are first folded inwards according to the swivelling arrow 29 until they lie at the base 30. Thereafter the longer side walls 10 may be folded inwards according to the swivelling arrow 19. By an appropriate selection of the dimensions of the corner-embracing wall regions 11 and the level of the pivot axis 18 above the base 30 it is attained that in the folded state of the side walls 10 the front edges 16 of the corner-embracing wall regions 11 substantially lie at the level of the base 30, in the embodiment provided they lie exactly at the level of the underside of the base 30. In this way in the collapsed state of the container 1 the minimal remaining height possible is guaranteed. A limitation of the folding distance of the first side walls 10 is formed therein that the step at the beginning of the connection wall area 12 will rest at the top side of the second wall plinth regions 32.

Furthermore it is visible in FIG. 2 how the two connection wall regions 12, 22 of the first side wall 10 cooperate with the second side wall 20. In the erected state of the side walls 10, 20 they will complete each other to form the total wall thickness in the region of the side walls 10, 20 outwards of the connection wall regions or cooperating recessed areas 12, 22. In these connection wall regions 12, 22 additional lock means are provided which are to be released manually or by automatic handling devices to lock the side walls 10, 20 in the erected state with each other, and to release them with little effort, and then collapse them.

Furthermore FIG. 2 illustrates the function of the widenings 21 and the support faces 27 at the second side wall 20. As it is visible at the right side of FIG. 2 the support faces 27 will lie in one plane with the upper edge of the wall plinth regions 31. Thereby they form a common support face for the lower edge 13 of the second side wall 10. By this means the side wall 10 may be heavily loaded enabling the stacking of several loaded containers 1 one on top of the other without any problems and with sufficient safety.

The height of the side walls 10 forming the longer side of the container 1 is dimensioned such that in the folded state the two opposite longer side walls 10 will lie with their upper edges 15 one in front of the other. In this state the two first side walls 10 have a horizontal position which enables the stacking of several empty folded containers 1 without the danger of tilting the stack.

The container 1 preferably consists of plastic material wherein for practical reasons the base 30 and the four side walls 10, 20 each are manufactured as plastic material injection molded parts. Furthermore the base 30 and the side walls 10, 20 are preferably designed with outer ribs in order to attain a high stability with little weight. When required the base 30 and/or the side walls 10, 20 may be provided with ventilation and/or draining apertures or slots. Furthermore at least at the two second side walls 20 handling apertures are provided, which are not illustrated in the FIGS. 1 and 2 of the drawing.

As an alternative to the embodiment illustrated also the second side walls may form the longer sides of the container, and the first side walls may form the shorter sides of the container.

Figure 3:
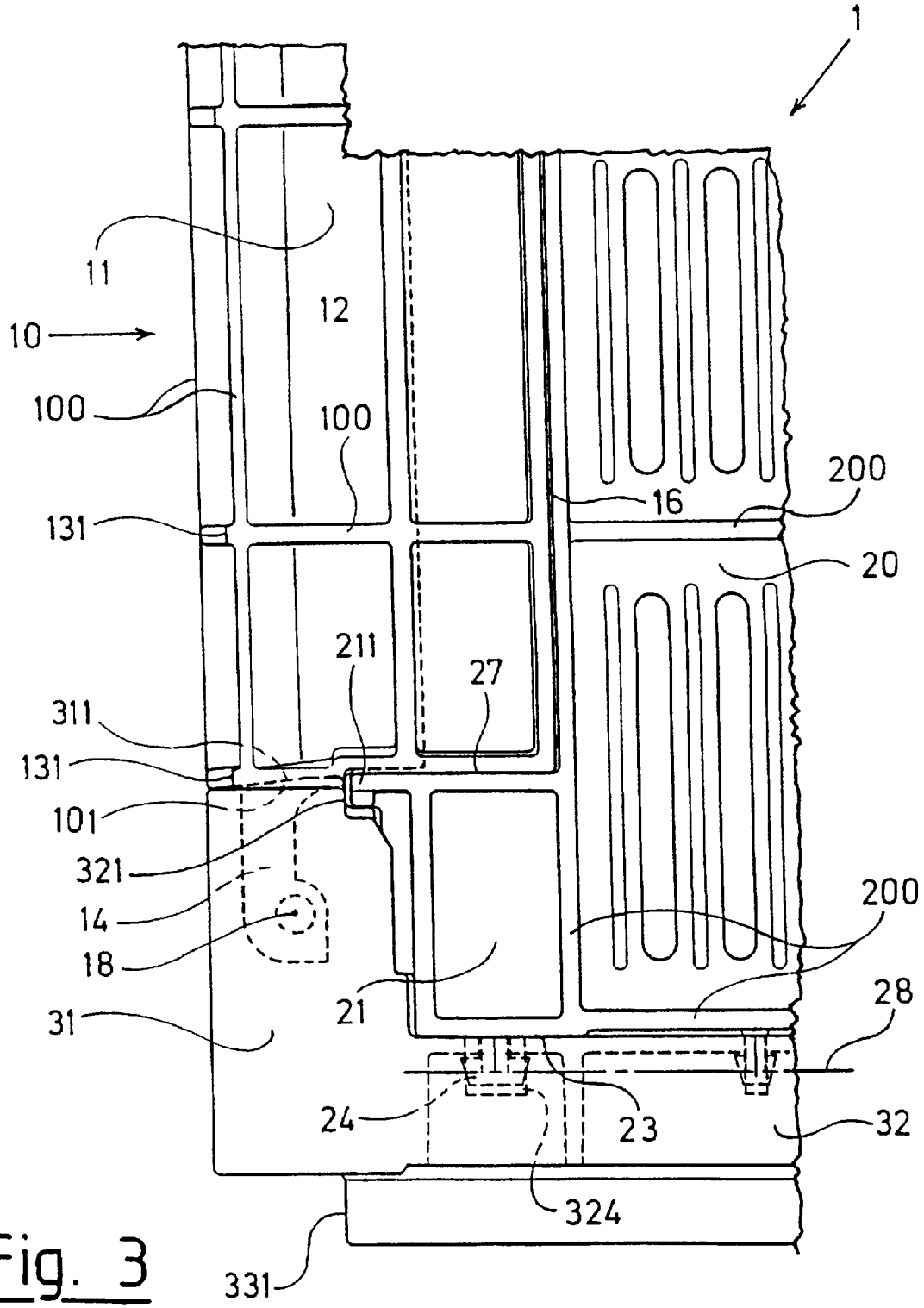
FIG. 3 illustrates a container viewed at the left lower part of one of its front sides wherein the plane of the drawing extends in parallel with the plane of the second side walls in the erected state.

FIG. 3 of the drawing illustrates the lower region of a corner region of the collapsible transport and storage container 1 wherein in the lower region of the illustration the base 30 is visible with the integrally formed wall plinth regions 32 and 31. In the right part of the FIG. 3 above the wall plinth region 32 the left end region of one of the second side walls 20 is visible; in the left part of FIG. 3 above the wall plinth region 31 the corner-embracing wall region 11 of one of the two first side walls 10 is visible. The side wall 20 at the underside 23 thereof comprises the hinge elements 24 which are inserted in the hinge receiving apertures 324 in the wall plinth region 32. As the hinge elements 24 as well as the associated hinge receiving apertures 324 are not visible from the outside they are shown in dashed lines in FIG. 3. In a corresponding matter also the side wall 10 is connected with the associated wall plinth region 31 wherein also in this case one of the hinge elements 14 hidden in the wall plinth region 31 is shown in dashed lines. The side wall 10 is pivotable about the axis 18, and the side wall 20 is pivotable about the axis 28 both pivot towards the interior of the container.

The base 30 is designed with a continuous stacking border 331 projecting like a web downwards with the stacking border stepping back versus the outer contour of the wall plinth regions 31, 32. The dimension of this back-step is somewhat larger than the thickness of the side walls 10, 20 such that a safe stacking of the container 1 with a like container is possible also with erected side walls 10, 20. Also a stacking with common rigid containers with corresponding dimensions is possible.

At the left lower corner of the side wall 20 a widening 21 is visible which extends in direction to the wall plinth region 31, and to the side wall 10. With erected side walls 10, 20 as illustrated in FIG. 3 the widening 21 is positioned between the corner-embracing wall region 11 of the first side wall 10 and the base 30, more precisely the integral lower wall plinth region 32. The top side of the widening 21 forms a support face 27 for the underside of the corner-embracing wall region 11 of the first side wall 10. Additionally a bracket 211 is provided at the widening 21 with the bracket projecting outwards which is the left side in FIG. 3. The bracket 211 is flush with the top side of the support face 27. For receiving this bracket 211 a corresponding downstep or slot 321 is provided on top of the front end of the wall plinth region 31 such that the bracket 211 in the erected state of the side walls will lie between the underside of the corner-embracing wall region 11 of the first side wall 10 and the wall plinth region 31. Thereby the connection of the side walls 10, 20 is improved with each other and with the base with its wall plinth regions 31, 32 with erected side walls 10, 20, in particular with a top load caused by stacked further containers 1.

In the upper part of FIG. 3, it is illustrated that in regions where the side walls 10, 20 abut both walls comprise overlapping wall end regions 12, 22 wherein the wall end region 12 of the first side wall 10 abuts at the outer side of the container 1, and is facing a viewer, whereas the wall end region 22 of the second side wall 20 abuts at the inner side of the container 1 and therefore is not visible for the viewer as it is hidden by the wall end region 12. In the overlapping region the wall end regions 12, 22 each comprise half the thickness of the side walls 10, 20 in the remaining regions such that the wall end regions 12, 22 complete each other to form the total wall thickness of the side walls 10, 20.

As mentioned before several containers 1 may be stacked one on top of the other for this reason the top side 15, 25 of the side walls 10, 20 not visible in FIG. 3 are formed with a continuous upper stacking border the contour of which is designed such that it embraces the lower stacking border 331 when several containers 1 are stacked.

In the embodiment of the container 1 illustrated in FIG. 3 the side walls 10, 20 are designed as faces with outward projecting ribs 100 or 200, respectively, extending in vertical and in horizontal direction. In the horizontally extending ribs 100 of the first side wall 10 steps 131 are provided which are visible at the upmost left region of FIG. 3. In the folded state of the side walls 10 the steps 131 form a vertical step in the surface of the folded container 1. In this folded state of the container 1 the steps 131 serve for securing a stacked further container 1 against slippage across the longitudinal direction of the first side walls 10. For this reason the stacking border 331 at the underside of the stacked container 1 embraces the rear of the steps 131 whereby the required safety against a horizontal displacement is attained. Corresponding steps 131 are provided at all four corners of the container 1 such that when the side walls 10 are folded at two opposite front sides of the container 1 continuous steps will result in the contour of the top side.

Finally it is illustrated in FIG. 3 that the wall plinth region 31 at least along a part of the length of the upper side thereof is formed with a bevelling 311 extending outwards from the interior of the container. The first side wall 10 at the underside thereof is designed with a bevelling 101 in corresponding areas which match the bevelling 311. By these bevellings 101, 311 it is attained that when loading the container 1 particularly from the first side wall 10 thereof from the top the tendency of the lower end of the side wall 10 to migrate toward the interior of the container is counteracted. Furthermore it is attained by this contour of the underside of the first side walls 10 and the upper side of the associated wall plinth regions 311 that starting from the erected state of the side walls 10 when folding them towards the interior of the container a certain friction resistance has to be overcome. This resistance therefor serves for holding them the first side walls 10 when erected automatically in this state even when the second side walls 20 are not yet erected and connected with the first side walls 10. Thereby in particular the transfer of the container 1 from its state with folded side walls 10, 20 into the state with erected side walls 10, 20 is simplified and accelerated as the first side walls 10 erected firstly will hold their positions without further means such that the operator folding up the container 1 can use both hands for an simultaneous erection of the two second side walls 20.

For locking the side walls 10, 20 against each other in the erected state in total four locks 4 are provided at the container 1 with the locks provided in pairs at the two second side walls 20.

Figure 4:
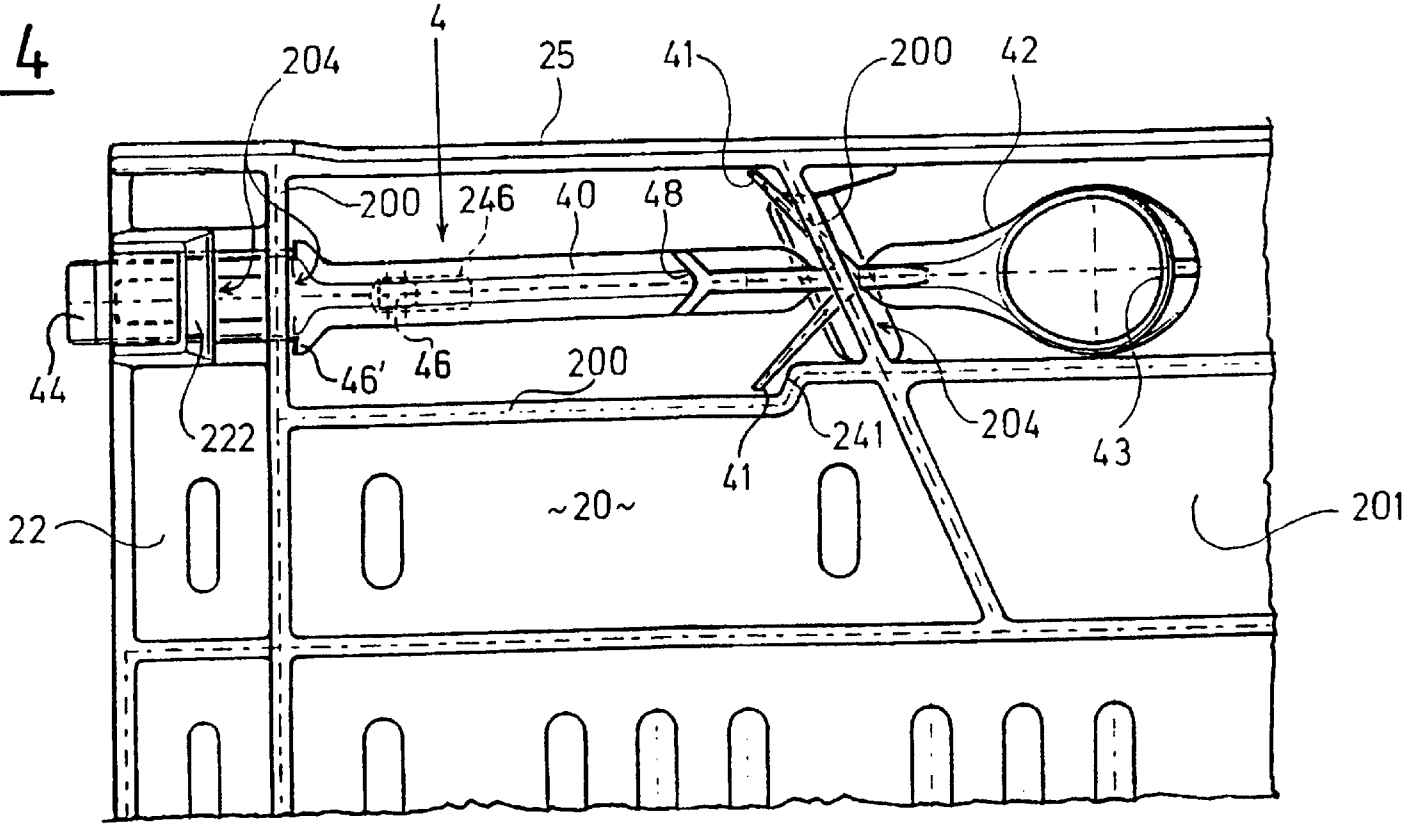
FIG. 4 illustrates a second side wall of a container in a part view at the left upper corner region with a lock for locking two adjacent container side walls with each other.

FIG. 4 of the drawing illustrates a section of one of the side walls 20 with a lock 4. Each lock 4 consists of a flat elongated basic body 40 whose outer end forms a lock end 44 pointing towards the side wall 10 not illustrated. In the state illustrated in FIG. 4 the lock 4 has its lock position, and the lock end 44 is in its outer position for engagement with the adjacent side wall 10 not illustrated.

Beside the basic body 40 each lock 4 comprises an actuating end 42 with a actuating handle 43 which in this case is designed as an eye for receiving a human thumb or finger. Furthermore the basic body 40 carries two V-shaped diverging spring arms 41 which are supported at the side wall 20, more precisely at ribs 200 or a step 241 designed therein, respectively of the container 1. The lock 4 in the longitudinal direction thereof is guided displaceably in apertures 204 which are positioned in several of the ribs 200 at the outer side of the side wall 20 facing the viewer. The spring arms 41 bias the lock 4 with a force acting in the locking direction whereby the lock 4 is secured in its lock position as long as no outer forces act on it.

Furthermore FIG. 4 in the connection wall region 22 illustrates a centering means for mutual centering the collapsible side walls 10, 20 during the erection thereof. In this case the centering means consists of a centering cam 222 projecting outwards from the connection wall region 22, with a aperture 122 provided in the side wall 10 for receiving the centering cam 222.

At each of the two side walls 20 two locks are arranged symmetric in relation to the center vertical line of the side wall 20. Below the actuating ends 42 with the actuating handles 43 there is a handling aperture 201 in the side wall 20 serving for gripping the container 1 with erected side walls 10, 20. The actuating handles 43 of the two locks 4 are positioned directly above the handling aperture 201 and are spaced from each other such that a simultaneous actuation of the two locks 4 by thumb and index finger of the hand of an operator is easily possible. For releasing the lock it is sufficient to move the locks 4 by pressing the actuating handles 43 against each other whereby the engagement of the lock ends 44 of the locks 4 with the side walls 10 is released. Thereafter a collapsing of the container 1 is possible. A further pair of two locks 4 is provided at the second side wall 20 positioned in the rear wherein the arrangement is symmetric. In this way a simultaneous actuation of in total four locks 4 by the two hands of an operator is possible.

Finally in the example of the lock 4 illustrated in FIG. 4 an engaging element 48 is provided at the upper side of the lock basic body 40 facing the viewer. This engaging element 48 consists of a V-shaped web which opens to the lock end 44. By means of the engaging element 48 in particular an actuating member of an automatic handling device, e.g. an automatic container washing unit is to be engaged in order to transfer the container 1 from the state with the side walls 10, 20 erected into a state with the side walls 10, 20 folded without any manual operations, for instance, during a washing process.

The mounting of the lock 4 at the side wall 20 carrying and guiding the lock is simply provided. The lock 4 with the lock end 44 in front according to FIG. 4 is pushed from right to left into the apertures 204 until the spring arms pass the aperture 204 which is shown at the right side of FIG. 4. In this position a displacement stop 46 will snap-in the associated slot 246 of the side wall 20 with the displacement stop projecting from the back side of the lock basic body 40, whereafter the lock 4 takes the position illustrated in FIG. 4. In this position the lock 4 is captively connected with the side wall 20. As when mounting the lock 4 a mounting movement is necessary in only a single direction this mounting step may be accomplished in an automatic fashion relatively easily which contributes to the low manufacturing costs of the container 1. Preferably the side walls 20 have been provided with the associated locks 4 before they are connected with the base 30 of the container 1.

In order to avoid that the lock 4 is pushed beyond the lock position illustrated in FIG. 4 the lock 4 at the transfer region from its basic body 40 to the lock end 44 comprises a widening or stop 46' acting as a stop, with the widening in the lock position of the lock 4 illustrated contacts the rib 200 of the side wall 20 extending at this position.

At the same time the possibility to replace the lock 4 when necessary still exists, in particular when it is damaged, for which reason the displacement stop 46 has to be pushed out of its slot 246 wherein the lock 4 is elastically flexibly deformed.

Figure 4A:
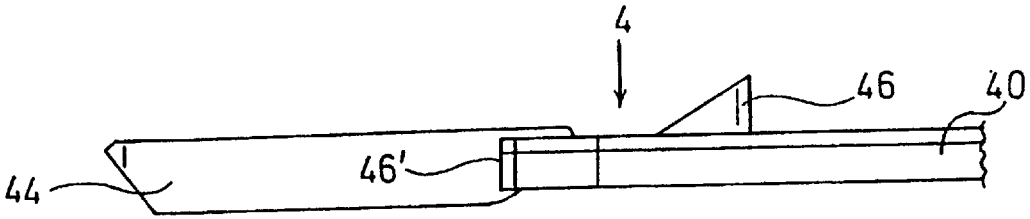
FIG. 4*a* illustrates the lock of FIG. 4 in a part plane view.

FIG. 4*a* illustrates the lock 4 of FIG. 4 in a part plane view. At the left side the lock end 44 of the lock 4 is visible with the lock end continuing at the right side into the basic body 40. In the transfer region between the lock end 44 and the basic body 40 there is the widening 46' forming the stop to limit the displacing movement of the lock 4 in direction of the lock position. At the rear side not visible in FIG. 4 and pointing upwards in FIG. 4*a* there is the displacement stop 46. As it is clearly visible in FIG. 4*a* the displacement stop 46 is designed wedge-shaped wherein the flat end points toward the lock end 44. With this design in particular it is attained that the lock 4 during the mounting thereof may be guided in the associated side wall 20 without any problems in the apertures 204 in the ribs 200. The higher side of the displacement stop 46 forms the stop to limit the displacing movement of the lock 4 in the release direction.

Figure 5:
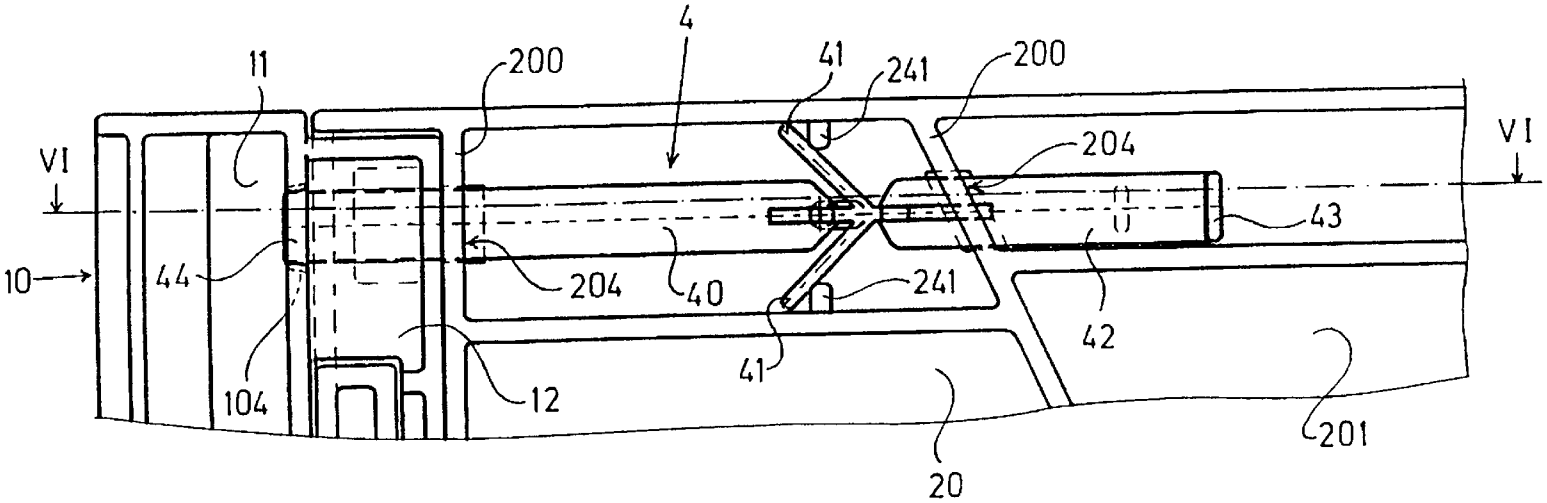
FIG. 5 illustrates a container in a part view at the left upper region of its front side with a lock changed in relation to FIG. 4, and in its lock position.

FIG. 5 illustrates the form and function of the lock 4 in a second embodiment wherein also the adjacent side wall 10 is illustrated. At the left side in FIG. 5 the side wall 10 with its corner-embracing wall region 11 and its connection wall region 12 is visible. At the right side the side wall 20 with its ribs 200 and its handling aperture 201 is shown.

The lock 4 is guided with its basic body 40 and its actuating end 42 in the apertures 204 in axial direction wherein the apertures 204 are each provided in the ribs 200. As the basic body 40 and the actuating end 42 of the lock 4 may be designed relatively flat a relatively small height of the apertures 204 is sufficient which will not impair the function of the ribs 200 regarding the stiffening and stabilization of the side wall 20.

FIG. 5 illustrates the lock 4 in its lock position wherein it takes a position maximally displaced to the associated side wall 10. In this position the lock end 44 of the lock 4 engages an associated slot shaped lock receiver 104 in the side wall 10. In this position, the side wall 20 may not be folded in relation to the side wall 10 to the interior of the container as such a movement is prevented by the engagement between the lock 4 and the side wall 10.

In the position described the lock 4 is secured by the two spring arms 41 which are designed integral with the remaining parts of the lock 4, and which are supported at the supporting webs 241 which are made integral with the side wall 20.

At the right end of the lock 4 illustrated in FIG. 5 the actuating handle 43 is visible which is positioned at the inner end of the handling end 42 of the lock 4 above the handling aperture 201 of the side wall 20, and which in the example shown comprises the form of a right angle.

Figure 6:
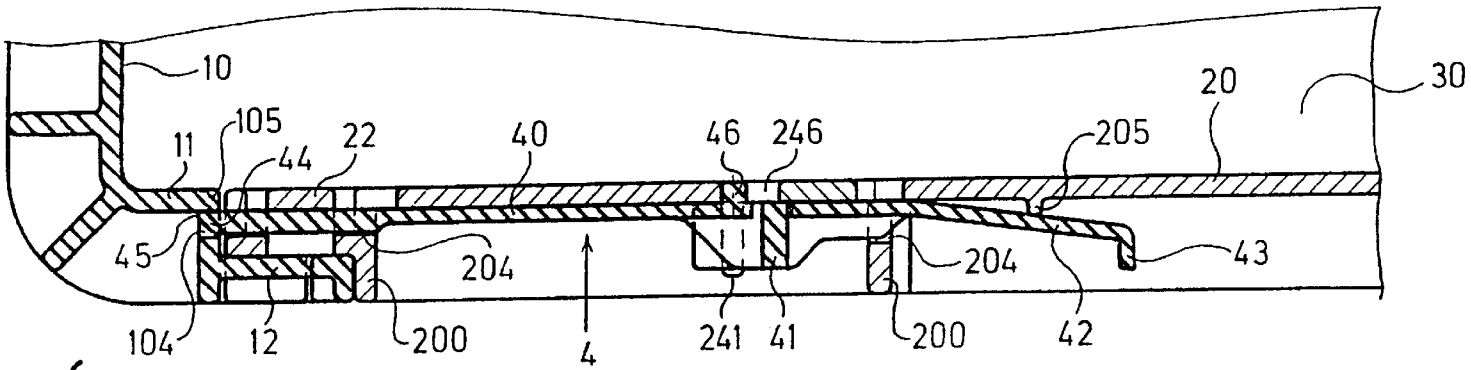
FIG. 6 illustrates the container of FIG. 5 in a part horizontal section along the line VI—VI in FIG. 5.

FIG. 6 in particular illustrates in a section along the line VI—VI in FIG. 5 the flat and space-saving embodiment of the lock 4 and its guidance in the apertures 204 in the ribs 200 of the side wall 20. In the left region of FIG. 6 the side wall 10 with its corner embracing wall region 11 and the connection wall region 12 is visible. Above the connection wall region 12 in FIG. 6, there is the associated connection wall region 22 of the side wall 20. In this region the locking of the side walls 10, 20 with each other by means of the lock 4, more precisely by the lock end 44 thereof will take place.

FIG. 6 illustrates the engagement of the lock end 44 in the lock receiver 104 of the side wall 10. In order to guarantee an automatic positioning of the lock position after the erection of the side wall 10, the corner-embracing wall region 11 of the side wall 10 is designed with an inlet bevelling 105, and the lock end 44 is designed with a wedge-shaped tip 45. By this means it is attained that the lock moves backwards like in a door lock when erecting the side wall 20 without a further actuation, i.e. it is moved to the right side in FIG. 6 until the lock end 44 automatically snaps in the lock receiver 104 under the influence of the spring arms 41.

To limit the displacement distance of the lock 4 in the mounted state thereof, a displacing stop 46 is provided at the underside or backside of the basic body 40 facing the side wall 20 with the displacing stop engaging in a correspondingly shaped slot 246 in the side wall 20.

At the right side in FIG. 6, the actuating end 42 with the actuating handle 43 of the lock 4 is visible. In order to facilitate the engagement of the actuating handle 43 by the operator the actuating end 42 is somewhat bent outwards in relation to the plane of the side wall 20 in this embodiment of the lock 4. This bending is attained in that below the actuating end 42 of the lock 4 a short side wall rib 205 is attached protruding out of the plane of the side wall 20 outwards.

In the background in FIG. 6 within the side walls 10, 20 a small part of the base 30 of the container is visible.

Figure 7:
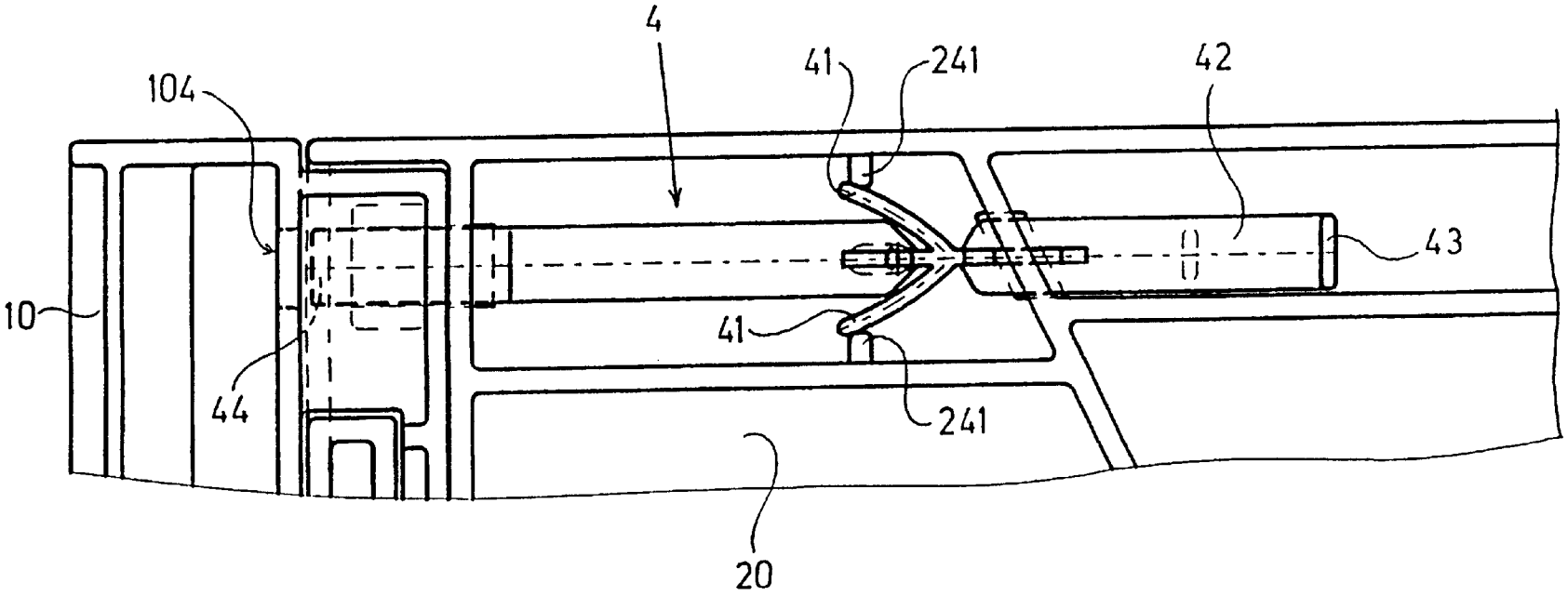
FIG. 7 illustrates the container in the same view as in FIG. 5, however, with the lock in a release position.

FIG. 7 of the drawing illustrates the lock 4 in the same mode of illustration as in FIG. 5, however, in the release position thereof. To transfer the lock 4 in this released position an actuating force is actuated thereon preferably by gripping the actuating handle 43 with the thumb or index finger of the hand of an operator and displacing it in the direction of the movement arrow indicated at the actuating handle 43. By this means the lock 4 is displaced against the force of the spring arm 41 until the lock end 44 thereof is out of engagement with the lock receiver 104 in the side wall 10. When simultaneously the same release operation is performed with the lock 4 attached at the right side of the side wall 20, and not visible in FIG. 7 the side wall may be easily folded towards the interior of the container in relation to the side wall 10.

After a short part of the folding distance, the actuating force acting on the actuating handle 43 may be released, the lock 4 thereafter moves back under the influence of the spring force of the spring arms 41 in the lock position thereof not hindering the further folding of the side wall 20.

Figure 8:
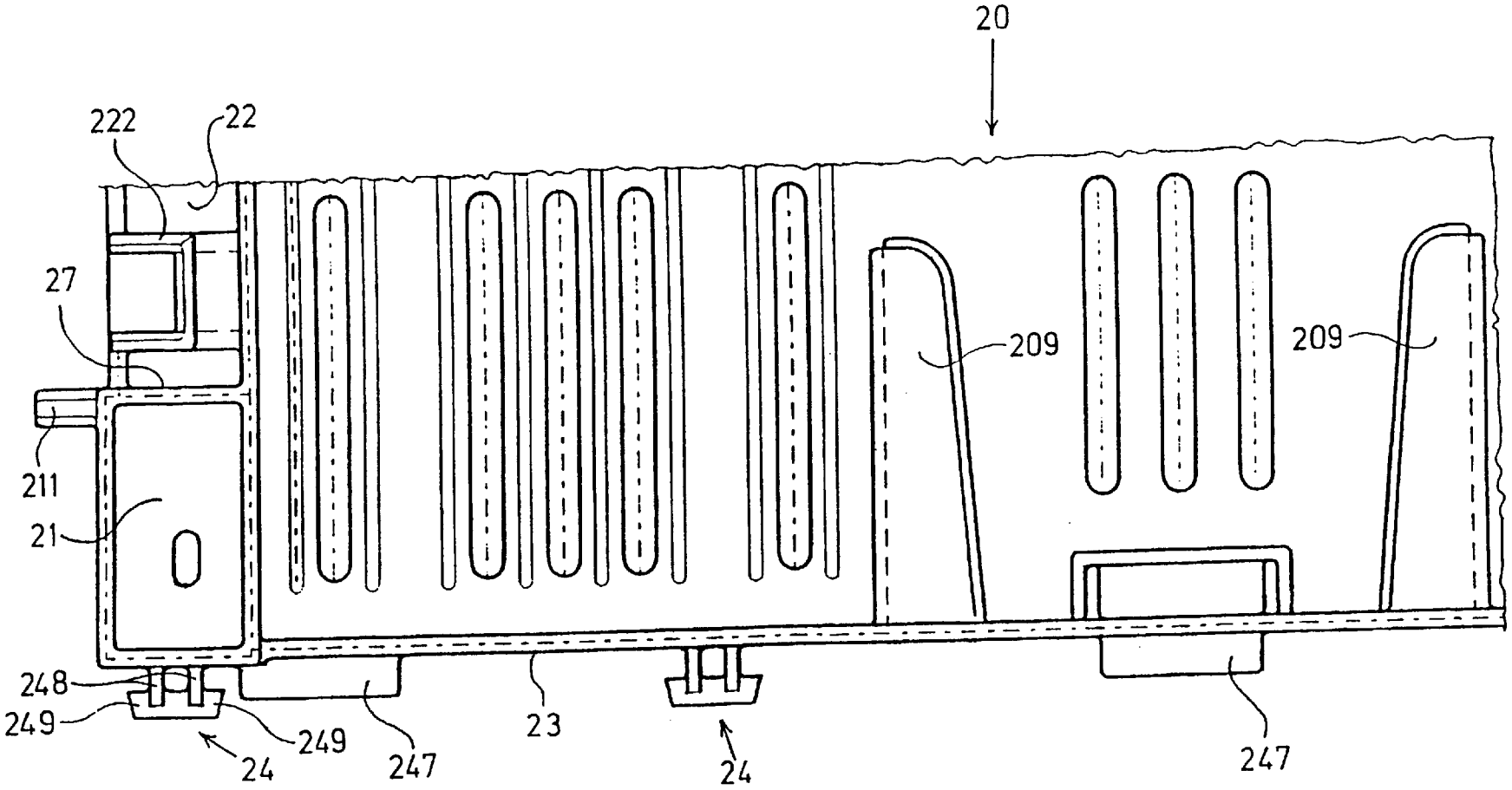
FIG. 8 illustrates a second side wall of a container in a part view at the left lower region.

FIG. 8 of the drawing illustrates one of the second side walls 20 in a part view wherein the lower part of the left border, and the left and also the middle part of the lower border of the side wall 20 is illustrated.

At the left upper part of FIG. 8 the lower part of the connection wall region 22 is visible wherein in the lower end region a centering cam 222 is arranged. The connection wall region 22 cooperates with the corresponding connection wall region 12 of the adjacent first side wall 10 as already described referring to FIG. 1 and 2, in the same way the centering cam 222 cooperates with a centering aperture in the adjacent side wall 10.

Below the connection wall region 22, the widening 21 is visible forming with the upper side thereof the support face 27. A bracket 211 extends therefrom to the left side flush with the support face.

Furthermore FIG. 8 illustrates two of several hinge elements 24 extending from the lower edge 23 of the side wall 20 downwards with the hinge elements 24 in the embodiment illustrated formed by a pair of downwards projecting webs 248 which carry a hinge axis being formed by two outwards projecting axle stubs 249. The outer front ends of the axle stubs 249 are wedge-shaped and bevelled downwards. This bevelling serves to facilitate the mounting of the side walls 10, 20 and the base 30 wherein only by enacting a force the hinge elements 24 are pressed into the corresponding hinge receiving apertures 314, 324 of the base 30, and are snapped-in. This connection of the side walls 10, 20 with the base 30 by mutual snap-in in the region of the hinge elements 14, 24 preferably is attained when the side walls are folded in as a good mutual guidance is attained facilitating the mounting. Furthermore in this way the hinge receiving apertures 314, 324 in the base 30 may be made smaller in the upwards direction thereof and thus take greater loads improving the load carrying capacity of the container 1 in particular when it is gripped in the region of the side walls 10, 20, and lifted.

Between two hinge elements 24 in the embodiment shown in FIG. 8 wings 247 are provided at the side wall 20 projecting downwards from the lower edge 23 with the wings in the erected state of the side walls 10, 20 positioned at the outer sides of the upper border of the associated wall plinth regions 31, 32 of the base 30 not shown in FIG. 8. These wings 247 prevent the influence of outer forces on the side wall 20 in the lower part thereof in which they could may be pressed into the interior of the container with the hinge elements 24 snapping out. The same is true for the correspondingly designed first side walls 10.

Finally FIG. 8 in the right part thereof illustrates two webs 209 substantially extending in parallel with each other which form a receiver for a container label or container documents. The label or the documents may be pushed from top to bottom and thus are secured in a safe way at the container for the transport or storage.

Figure 9:
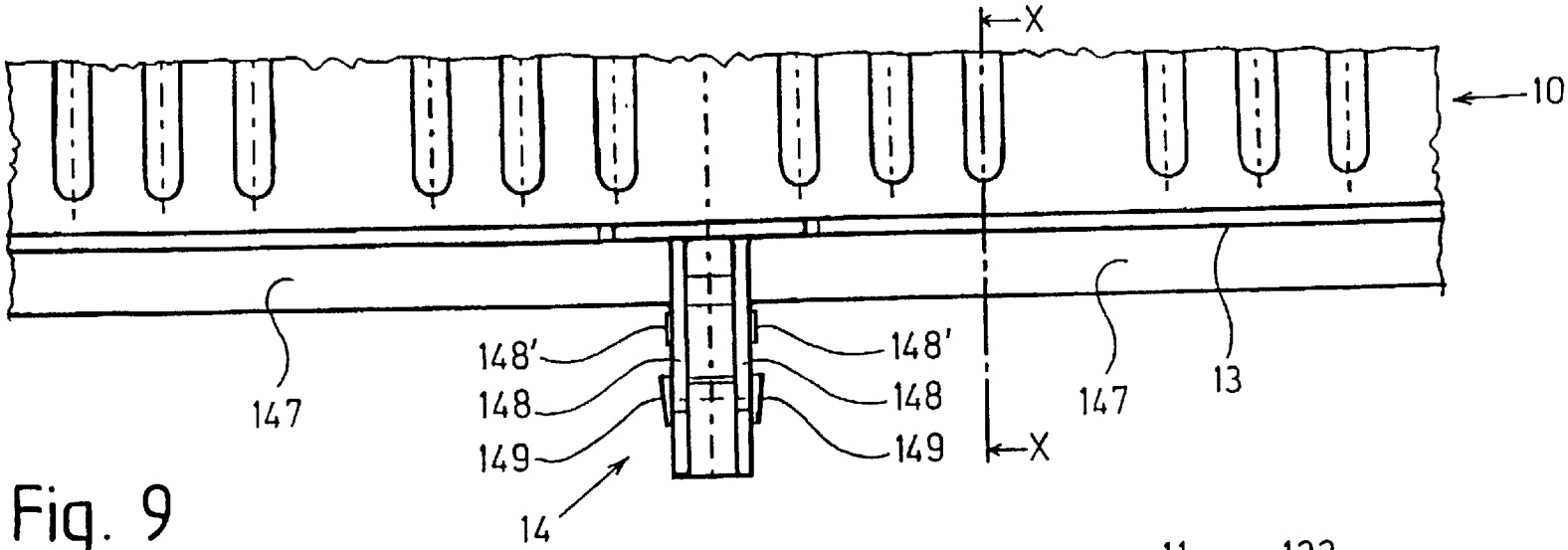
FIG. 9 illustrates a first side wall of a container in a part view at the middle lower region of its outer side prior to the connection of the side wall with the base.

FIG. 9 of the drawing illustrates a section of the first side wall 10 namely the middle lower part of the outer side wherein the side wall 10 is illustrated in a state separated from the base. The side wall 10 is downwards limited by the lower edge 13. A continuous apron 147 extends at the inner side downwards.

Finally in the middle lower part of FIG. 9 one of the hinge elements 14 is visible which extends from the lower edge 13 of the side wall 10 downwards wherein the extension thereof is substantially larger then the length of the apron 147 in vertical direction. Also the hinge element 14 according to FIG. 9 consists of two parallel webs 148 extending downwards which each carry an axle stub 149 at the outer sides thereof. These axle stubs 149 cooperate with the hinge receivers 340 for pivoting the side wall 10 in the base 30 (not illustrated).

In order to prevent a swivelling of the side wall 10 beyond the erected state thereof outwards in relation to the base the apron 147 is attached. This apron 147 in the erected state of the side wall 10 abuts at the inner side of the upper border region of the associated wall plinth region 31 of the base 30. In order to prevent an inadvertent automatic falling back of the erected side walls 10 before the second side walls 20 are erected laterally projecting snap-in cams 148' are attached at both webs 148 above the axle stubs 149. In the erected state of the side wall 10 these snap-in cams 148' act as a locking by snappingly engaging correspondingly formed regions of the hinge receivers 314 at the base 30.

Figure 10:
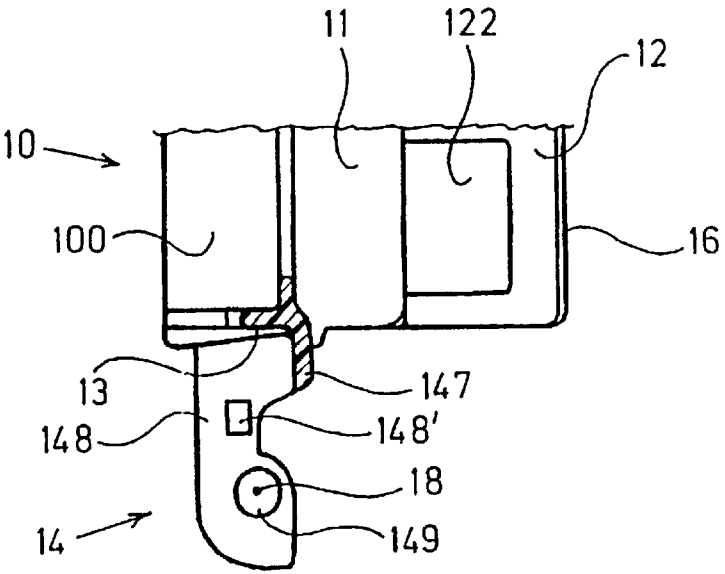
FIG. 10 illustrates the side wall of FIG. 9 in a part cross-section along the line X—X in FIG. 9.

In FIG. 10 the design of the lower border region of the first side wall 10 with the associated hinge element 14 is illustrated in a section according to the line X—X in FIG. 9. In the left upper part a part of the first side wall 10 is visible reinforced by a rib 100 positioned in the background. At the right side of the side wall 10 the lower part of the corner-embracing wall region 10 is visible. Further at the right side in FIG. 10 connected with the corner-embracing wall end region 11 the connection wall region 12 is positioned ending in the free edge 16. Within the connection wall region 12 one of the centering apertures 122 is visible.

The side wall 10 is limited downwards by its lower edge 13 from which the hinge element 14 extends downwards. Facing the viewer is one of the webs 148 from which the centering cam 148' and the axle stub 149 project forming the pivot axis 18.

At the right side below the lower edge 13 of the side wall 10, the apron 147 is illustrated in a section serving for limiting the swivelling movement of the side wall 10 beyond the erecting state thereof.

Figure 11:
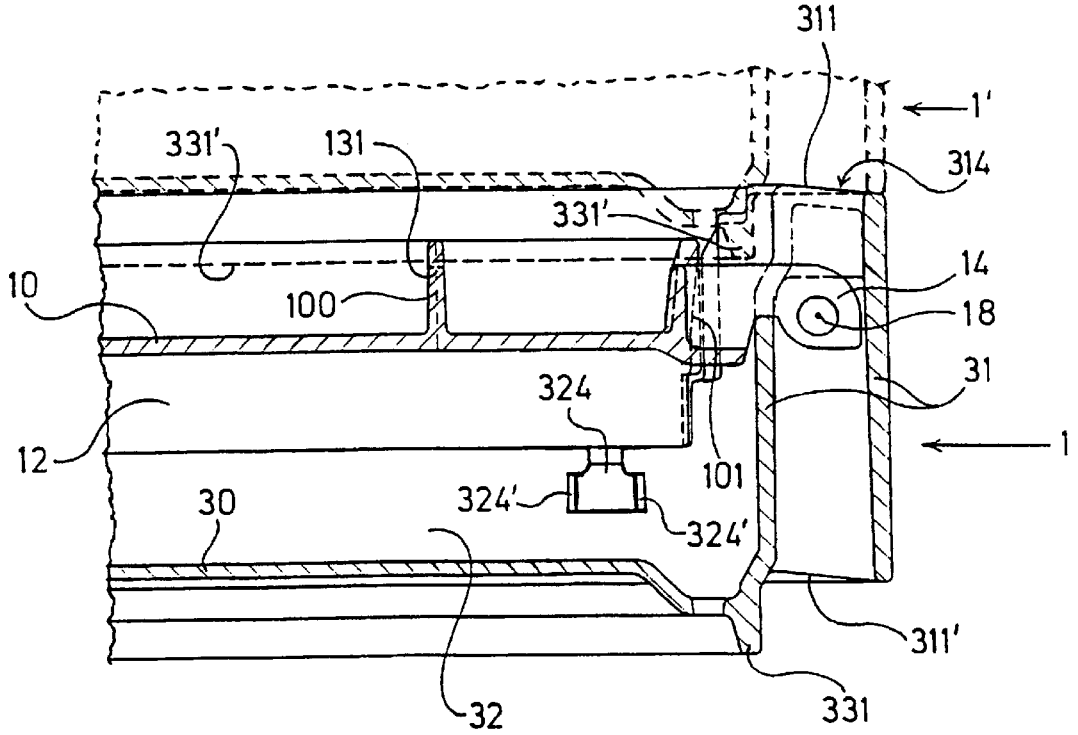
FIG. 11 illustrates a container in a part vertical section in parallel with the plane of the second erected side walls wherein the first side wall is collapsed, and the second side wall is not illustrated.

FIG. 11 of the drawing in a part section illustrates the state of the container 1 with folded first side wall 10 wherein the second side wall 20 is not shown to simplify the Figure.

In the lower part of FIG. 11 firstly the base 30 is visible with the lower staple border 331 made integral with it. Also the wall plinth region 31 is made integral with the base 30 with the wall plinth region illustrated at the right side in FIG. 11. By means of this wall plinth region 31 the first side wall 10 is articulatedly connected by means of the hinge elements 14 one of which is visible. The hinge element 14 is inserted into the corresponding hinge receiving aperture 314 of the wall plinth region 31. In the folded state, the side wall 10 extends in parallel with the base 30 on top of it. In the space between the inner side of the first side wall 10 now pointing downwards, and the top of the base 30 the not illustrated side walls 20 rest which have been folded before. The side walls 20 are articulatedly connected with the wall plinth region 32 visible in the background with the wall plinth region 32 comprising the hinge receiving apertures 324. The hinge receiving apertures 324 are formed with inlet bevellings 324 pointing to the interior of the container and widening in this direction with the inlet bevellings facilitating the introduction of the hinge elements 24 when mounting the side wall 20 and the base 30. Also the hinge receiving apertures 314 for the first side walls 10 are correspondingly designed. The first side walls 10 and also the second side walls 20 in the illustrated embodiment of the container 1 are connected with the base 30 in the folded or horizontal position. For this reason also the inlet bevellings 324 and the corresponding inlet bevellings for the first side walls are positioned such that they point to the interior of the container 1.

As has been described before the wall plinth region 31 at the upper side thereof at least at a part of the length thereof is designed with a bevelling 311 as it is visible at the right upper side of FIG. 11. At the right lower side in FIG. 11 it is visible that the wall plinth region 31 also at the lower side thereof is designed with a bevelling 311' at the underside extending in parallel with the bevelling 311. This bevelling 311' serves for stacking a further container 1' indicated with dashed lines in an exact way secured against displacement when the side walls 10, 20 are collapsed. At the same time the wall plinth regions 31 are designed with such a height and contour at the top sides thereof that the stacked further container 1' with the stacking border 331' at the underside thereof is embraced by the wall plinth regions 31 at the outer side such that a mutual displacement of the containers 1, 1' within the stack in a direction crosswise to the wall plinth regions 31 is prevented. A relative displacement of the containers 1, 1' in a direction parallel with the wall plinth region 31 is prevented by the steps 131 in the ribs 100 of the first side wall 10. In FIG. 11 a rib 100 now pointing upwards is visible at the folded first side wall 10 abutting at the step 131 at the side at the end facing away from the viewer as has been explained in FIG. 3. Furthermore FIG. 11 illustrates that this step 131 is embraced in the rear by the lower stacking border 331' of the upper container 1'. A rear embracing is attained in the same way at the opposite front side of the container 1 whereby a displacement in both directions in parallel with the wall plinth region 31 is excluded.

At the same time FIG. 19 illustrates that when stacking containers 1, 1' one on top of the other with folded side walls 10, 20 the folded side walls 10, 20 are not stressed in vertical direction. By this means damages at the side walls 10, 20 in particular at the hinge elements 14, 24 thereof are prevented.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A collapsible container comprising:

a substantially rectangular base having a first pair of opposing edges and a second pair of opposing edges, the first pair of opposing edges each being connected to one of two opposing first side walls and the second pair of opposing edges each being connected to one of two opposing second side walls, the first pair of opposing edges of the base each comprises a first plinth region each of which supports one of said first side walls, the second pair of opposing edges each comprises a second plinth region each of which supports one of said second side walls;

each of said first and second side walls being pivotable between a collapsed position where the first and second side walls are generally parallel to the base and an upright position wherein the first and second side walls are generally perpendicular to the base, the first and second side walls being pivotable to the collapsed position characterized as the second side walls being pivoted downward over the base with the first side walls being pivoted downward over the second side walls, each first side wall comprising two opposing ends that each form corners, each of said corners comprising a corner embracing wall that is connected to a thin connecting wall region, each opposing end of each first side wall thereby terminating at one of the thin connecting wall regions, each first plinth region also comprising two opposing ends that form corners, the connecting wall regions of the first side walls extending past the corners formed by the opposing ends of the first plinth regions, each second side wall also including two opposing ends that terminate in connecting wall regions, each connecting wall region of each second side wall being in overlapping engagement with one connecting wall region of one of said first side walls and in abutting engagement with one corner embracing wall of one of said first side walls, the connecting wall regions of the first side walls being disposed laterally outside of the connecting wall regions of the second side walls when the first and second side walls are in the upright position, the edges of the base that are connected to the second side walls further comprising recesses for accommodating the connecting wall regions of the first side walls when the first side walls are in the collapsed position, each connecting wall region of each second side wall comprising a lock for locking said connecting wall region of said second side wall to one corner embracing wall of one of the first side walls when the first and second side walls are in the upright position and for centering the second side walls between the first side walls when the first and second side walls are in the upright position, the first plinth regions having a first height, the second plinth regions having a second height, the first height being greater than the second height, the second side walls further comprising a lower edge that comprises two opposing lateral extensions, each lateral extensions of each second side wall being disposed underneath one corner of one of said first side walls.

2. The container of claim 1 wherein each of said corner embracing walls comprises a length, a portion of each first side wall disposed between the corner embracing walls of each first side wall comprises a first side wall length, the length of each corner embracing wall ranging from about 5% to about 15% of the first side wall length.

3. The container of claim 1 wherein each of said corner embracing walls comprises a length, a portion of each first side wall disposed between the corner embracing walls of each first side wall comprises a first side wall length, the length of each corner embracing wall ranging from about 8% to about 10% of the first side wall length.

4. The container of claim 1 wherein each of said first side walls is connected to its respective first plinth region by at least one hinge.

5. The container of claim 1 wherein each of said second side walls is connected to its respective second plinth region by at least one hinge.

6. The container of claim 1 wherein the first side walls are connected to the first plinth regions by a plurality of hinges, each of said plurality of hinges comprising a laterally extending axle stub that is connected to a lower edge of one of the first side walls by a web, the lateral axle stubs being pivotally received in a recess disposed in an upper edge of one of the first plinth regions, and wherein the second side walls are connected to the second plinth regions by a plurality of hinges, each of said plurality of hinges comprising a laterally extending axle stub that is connected to a lower edge of one of the second side walls by a web, the lateral axle stubs being pivotally received in a recess disposed in an upper edge of one of the second plinth regions.

7. The container of claim 6 wherein the hinges of the first side walls further comprises snap-in frictional elements which hold the first side walls in an upright position without support from the second side walls.

8. The container of claim 1 wherein each of said first side walls further comprises a lower outer apron and each of said first plinth regions comprises an upper outer edge that engages the lower outer apron of one of the first side walls when the first side wall is in the upright position.

9. The container of claim 1 wherein each of said first side walls further comprises at least one lower outer wing and each of said first plinth regions comprises an upper outer edge that engages the lower outer wing of one of the first side walls when the first side wall is in the upright position.

10. The container of claim 1 wherein each second side wall comprises at least one lock for locking each second side wall against one of the first side walls when the first and second side walls are in the upright position, each of said locks comprising a moveable lock member that is spring biased into a locked position where it is received in a recess disposed in the corresponding first side wall and that is retractable into an unlocked position where the locking member is retracted away from the first side wall.

11. The container of claim 1 wherein each second side wall comprises at least one lock for locking each second side wall against one of the first side walls when the first and second side walls are in the upright position, each of said locks comprising a moveable lock member, each of said second side walls further comprising at least one stiffening rib that has an aperture through which the movable lock member passes.

12. The container of claim 1 wherein each second side wall comprises two oppositely directed locks for locking each second side wall against both of the first side walls when the first and second side walls are in the upright position.

13. The container of claim 1 wherein each second side wall comprises two oppositely directed locks for locking each second side wall against both of the first side walls when the first and second side walls are in the upright position, each lock comprising a movable lock member and an activating handle, the activating handles of the locks of each second side wall being disposed adjacent to each other.

14. The container of claim 1 wherein each first side wall comprises a lower edge and each first plinth region comprises an upper edge that supports the lower edge of one of the first side walls when the first side walls are in the upright position, the lower edge of each first side wall and the upper edge of each first plinth region having matching surface inclinations with respect to horizontal when the first walls are in the upright position.

15. The container of claim 14 wherein the upper edge of each first plinth region and the lower edge of each first side wall are inclined from horizontal and a matching surface angle ranging from about 4 degrees to about 8 degrees.

16. The container of claim 14 wherein the matching surface angle is about 6 degrees with respect to horizontal.

17. The container of claim 1 wherein the first plinth regions extend vertically above the first and second side walls when the first and second side walls are in the collapsed position.

18. The container of claim 1 wherein the lateral extensions of the second side walls further comprise a bracket extension which is received in a recess disposed in the first plinth regions when the second side walls are in the upright position.

19. The container of claim 1 wherein the first plinth regions comprise an upper edge and a lower edge, the upper edge of the first plinth regions providing a surface for supporting one of the first side walls when the first side walls are in the upright position, the upper edge of the first plinth regions also providing a stacking surface when the first and second side walls are in the collapsed position.

20. A collapsible container comprising:

a substantially rectangular base having a first pair of opposing edges and a second pair of opposing edges, the first pair of opposing edges each being connected to one or two opposing first side walls and the second pair of opposing edges each being connected to one of two opposing second side walls, the first pair of opposing edges of the base each comprises a first plinth region each of which supports one of said first side walls, the second pair of opposing edges each comprises a second plinth region each of which supports one of said second side walls, each of said first and second side walls pivoting between a collapsed position where each side wall is generally parallel to the base in an upright position where each side wall is generally perpendicular to the base, each first side wall comprising two opposing ends that each form corners, each of said corners comprising a corner embracing wall that is connected to a thin connecting wall region, each opposing end of each first side wall thereby terminating at one of the thin connecting wall regions, each first plinth region also comprising two opposing ends that form corners, the connecting wall regions of the first side walls extending past the corners formed by the opposing ends of the first plinth regions, each second side wall also including two opposing ends that terminate in connecting wall regions, each connecting wall region of each second side wall being in overlapping engagement with an inside surface of one connecting wall region of one of said first side walls and in abutting engagement with one corner embracing wall of one of said first side walls, the connecting wall regions of the first side walls being disposed laterally outside of the connecting wall regions of the second side walls when the first and second side walls are in the upright position, the first and second side walls being pivotable to the collapsed position which is characterized as the second side walls being pivoted downward over the base with the first side walls being pivoted downward over the second side walls, the edges of the base that are connected to the second side walls further comprising recesses for accommodating the connecting wall regions of the fist side walls when the first side walls are in the collapsed position, each connecting wall region of each second side wall comprising a lock for locking said connecting wall region of said second side wall to one corner embracing wall of one of the first side walls when the first and second side walls are in the upright position and for centering the second side walls between the first side walls when the first and second side walls are in the upright position, the first plinth regions having a first height, the second plinth regions having a second height, the first height being greater than the second height, the second side walls further comprising a lower edge that comprises two opposing lateral extensions, each lateral extensions of each second side wall being disposed underneath one corner of one of said first side walls, the first side walls are connected to the first plinth regions by a plurality of hinges, each of said plurality of hinges comprising a laterally extending axle stub that is connected to a lower edge of one of the first side walls by a web, the lateral axle stubs being pivotally received in a recess disposed in an upper edge of one of the first plinth regions, and wherein the second side walls are connected to the second plinth region by a plurality of hinges, each of said plurality of hinges comprising a laterally extending axle stub that is connected to a lower edge of one of the second side walls by a web, the lateral axle stubs being pivotally received in a recess disposed in an upper edge of one of the second plinth regions.

21. The container of claim 20 wherein each first side wall comprises a lower edge and each first plinth region comprises an upper edge that supports the lower edge of one of the first side walls when the first side walls are in the upright position, the lower edge of each first side wall and the upper edge of each first plinth region having matching surface angles with respect to horizontal when the first walls are in the upright position.

22. The container of claim 21 wherein the first plinth regions extend vertically above the first and second side walls when the first and second side walls are in the collapsed position.

23. A plurality of like collapsible containers comprising:

each container comprising a substantially rectangular base having a first pair of opposing edges and a second pair of opposing edges, the first pair of opposing edges each being connected to one or two opposing first side walls and the second pair of opposing edges each being connected to one of two opposing second side walls, the first pair of opposing edges of the base each comprises a first plinth region each of which supports one of said first side walls, the second pair of opposing edges each comprises a second plinth region each of which supports one of said second side walls;

each of said first and second side walls being pivotable between a collapsed position where each side wall is generally parallel to the base and an upright position where each side wall is generally perpendicular to the base, the collapsed position characterized as the second side walls being pivoted downward over the base with the first side walls being pivoted downward over the second side walls, each first side wall comprising two opposing ends that each form corners, each of said corners comprising a corner embracing wall that is connected to a thin connecting wall region, each opposing end of each first side wall thereby terminating at one of the thin connecting wall regions, each first plinth region also comprising two opposing ends that form corners, the connecting wall regions of the first side walls extending past the corners formed by the opposing ends of the first plinth regions, each second side wall also including two opposing ends that terminate in connecting wall regions, each connecting wall region of each second side wall being in overlapping engagement with one connecting wall region of one of said first side walls and in abutting engagement with one corner embracing wall of one of said first side walls, the connecting wall regions of the first side walls being disposed laterally outside of the connecting wall regions of the second side walls when the first and second side walls are in the upright position, the edges of the base that are connected to the second side walls further comprising recesses for accommodating the connecting wall regions of the first side walls when the first side walls are in the collapsed position, each connecting wall region of each second side wall comprising a lock for locking said connecting wall region of said second side wall to one corner embracing wall of one of the first side walls when the first and second side walls are in the upright position and for centering the second side walls between the first side walls when the first and second side walls are in the upright position, the first plinth regions having a first height, the second plinth regions having a second height, the first height being greater than the second height, the second side walls further comprising a lower edge that comprises two opposing lateral extensions, each lateral extensions of each second side wall being disposed underneath one corner of one of said first side walls, the first plinth regions comprise an upper edge and a lower edge, the upper edge of the first plinth regions providing a surface for supporting one of the first side walls when the first side walls are in the upright position, the upper edge of the first plinth regions also providing a stacking surface for the lower edge of a first plinth region of another like container when two or more like containers are stacked with their respective first and second side walls are in the collapsed position.

* * * * *